United States Patent [19]

Haarer

[11] Patent Number: 4,662,596

[45] Date of Patent: May 5, 1987

[54] SUPPORT BRACKET ASSEMBLY FOR WINDOW COVERING

[75] Inventor: Steven R. Haarer, Sturgis, Mich.

[73] Assignee: Cooper Industries, Houston, Tex.

[21] Appl. No.: 770,535

[22] Filed: Aug. 28, 1985

[51] Int. Cl.[4] ..... A47H 1/14

[52] U.S. Cl. ..... 248/251; 160/178 B; 248/262; 248/271

[58] Field of Search ..... 248/271, 251, 253, 252, 248/264, 262, 222.1, 221.3; 160/178 B, 178 R

[56] References Cited

U.S. PATENT DOCUMENTS

| | | | |
|---|---|---|---|
| 1,855,010 | 4/1932 | Coleman | 248/271 |
| 2,138,502 | 11/1938 | Nordstrom, Jr. et al. | 248/264 |
| 2,455,606 | 12/1948 | Pleiss | 248/251 |
| 2,673,608 | 3/1954 | Nelson | 160/178 R |
| 3,334,682 | 8/1967 | Eldredge, Jr. | 160/178 R |
| 3,579,711 | 5/1971 | Nicolin | 248/221.3 X |
| 4,029,038 | 6/1977 | Pfahl | 248/221.3 X |
| 4,352,433 | 10/1982 | Ford | 248/262 X |

FOREIGN PATENT DOCUMENTS

| | | | |
|---|---|---|---|
| 711078 | 6/1965 | Canada | 248/264 |
| 1242499 | 8/1960 | France | 16/94 |

*Primary Examiner*—Robert W. Gibson, Jr.
*Assistant Examiner*—David L. Talbott
*Attorney, Agent, or Firm*—E. E. Scott; A. R. Thiele

[57] ABSTRACT

A support bracket assembly for supporting a hollow tubular or channel shaped headrail for venetian blinds and similar window coverings comprising opposed support bracket members having projecting tongue portions which are insertable in supportive relationship within the headrail member. Opposed wall brackets include horizontally projecting support plate portions which are insertable in openings formed in the headrail support brackets and are in engagement with resiliently deflectable fingers on the headrail support brackets for securing the headrail brackets assembled to the wall brackets. Elastically deflectable arm portions are formed on the headrail brackets for engagement with the wall bracket plate portions for urging the headrail brackets toward each other to maintain firm engagement with the headrail.

8 Claims, 8 Drawing Figures

SUPPORT BRACKET ASSEMBLY FOR WINDOW COVERING

BACKGROUND OF THE INVENTION

1. Field of the Invention

The present invention pertains to a support bracket assembly for supporting the headrail of a venetian blind or similar type of window covering.

2. Background

In the art of support members for venetian blind assemblies and similar types of window coverings, it is conventional to provide an elongated usually somewhat channel shaped support member for supporting the mechanism for adjusting the blind slat position. This member, commonly referred to as the headrail, is typically supported in prior art arrangements in somewhat box shaped support brackets mounted at each end of the headrail and secured to a wall or ceiling surface. The box shaped brackets are typically provided with one side which is hinged to the remainder of the box and is movable to an open position to permit sliding the headrail into its supported position on the bracket.

The aforementioned types of brackets are difficult to adjust for the desired position of the headrail, for example, when centering the headrail in a window opening or the like. Prior art box type support brackets have also typically been made of painted metal which is often disfigured during the bracket installation process. Moreover, it is difficult to make the hinged portion of the support bracket so that it is easily movable between open and closed positions. Still further, prior art types of brackets have not been particularly aesthetically pleasing as it has been difficult to manufacture these brackets to have a shape conforming to the shape of the blind support member or headrail. These problems and undesirable characteristics of prior art type venetian blind support brackets and similar types of window covering supports have largely been overcome by the improved support bracket assembly of the present invention.

SUMMARY OF THE INVENTION

The present invention provides an improved support bracket assembly for the headrail or support member of a venetian blind set or similar type of window covering.

In accordance with an important aspect of the present invention there is provided a support bracket arrangement for a window covering headrail or support member characterized by opposed formed metal or molded plastic wall brackets which are formed of generally planar folded or as cast metal or plastic plate. The wall brackets are easily attached to a wall surface and preferably include a standoff locating tab to assist in locating the wall brackets in a socalled inside window opening type installation.

The improved wall brackets of the support bracket assembly are also provided with projecting plate portions which are cooperable with respective headrail support bracket members which support an elongated headrail therebetween. The headrail bracket members are uniquely configured to include a projecting plug or tongue portion extendable into the open ends of the channel shaped headrail member to assist in maintaining the shape and rigidity of the headrail member. The headrail bracket members are also provided with means for receiving the projecting plate portions of the wall brackets for supporting the headrail bracket members on the wall brackets.

In accordance with another important aspect of the invention the headrail bracket members each include deflectable support fingers which interfit in respective notches formed in the wall bracket plate portions for securing the headrail brackets to the respective wall brackets. The interfitted support fingers may be deflected out of engagement with the wall brackets to permit easy removal of the window covering assembly including the headrail member and the opposed headrail bracket members. The headrail bracket members also include deflectable blade portions which maintain the headrail bracket members in relatively snug or tight fitting engagement with the wall brackets and provide for centering and forcibly urging the headrail bracket members toward each other to maintain the headrail and the headrail support bracket members in assembly with each other.

In accordance with yet another important aspect of the present invention, there is provided a support bracket for a headrail or similar elongated support member for a venetian blind assembly or the like characterized as an integral molded plastic member having an axially projecting plug portion for insertion in and standing in supportive relationship to a channel shaped headrail or the like and being of a configuration similar to the headrail to provide an aesthetically pleasing appearance of the support structure for a venetian blind assembly or similar window covering.

The present invention holds several advantages over prior art support brackets for venetian blinds and similar window coverings. In addition to those advantages described hereinabove, and those readily recognizable by those skilled in the art, the arrangement of the wall brackets and the opposed headrail bracket members provides an aesthetically pleasing support structure which automatically is substantially centered between the opposed wall brackets. The configuration of the headrail bracket members is such that a minimal space is required between the top of the headrail and a ceiling or horizontal surface of the window opening above the headrail. The support brackets are relatively easy to mount and insertion of and removal of the headrail in assembly with the headrail support brackets with respect to the wall brackets is particularly easy to accomplish. Thanks to the provision of the headrail support brackets of molded plastic selected colors may be molded into the plastic compound and are not subject to discoloration due to chipping. Further advantages will be realized upon reading the detailed description which follows in conjunction with the drawing.

BRIEF DESCRIPTION OF THE DRAWING

FIG. 1 is an exploded perspective view of the improved support bracket assembly for a headrail of a venetian blind or the like;

DESCRIPTION OF A PREFERRED EMBODIMENT

Figure 1:
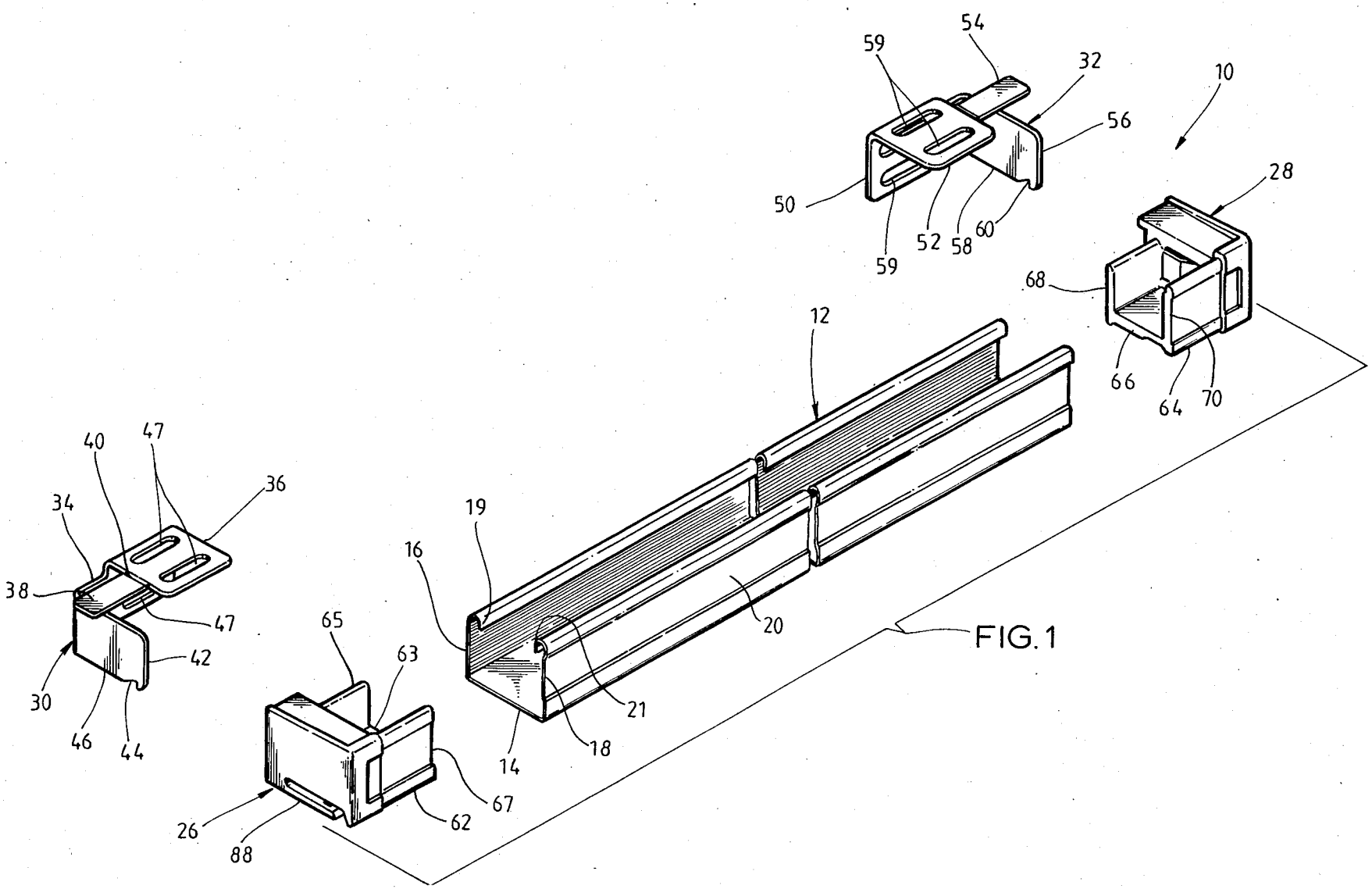
Figure 2:
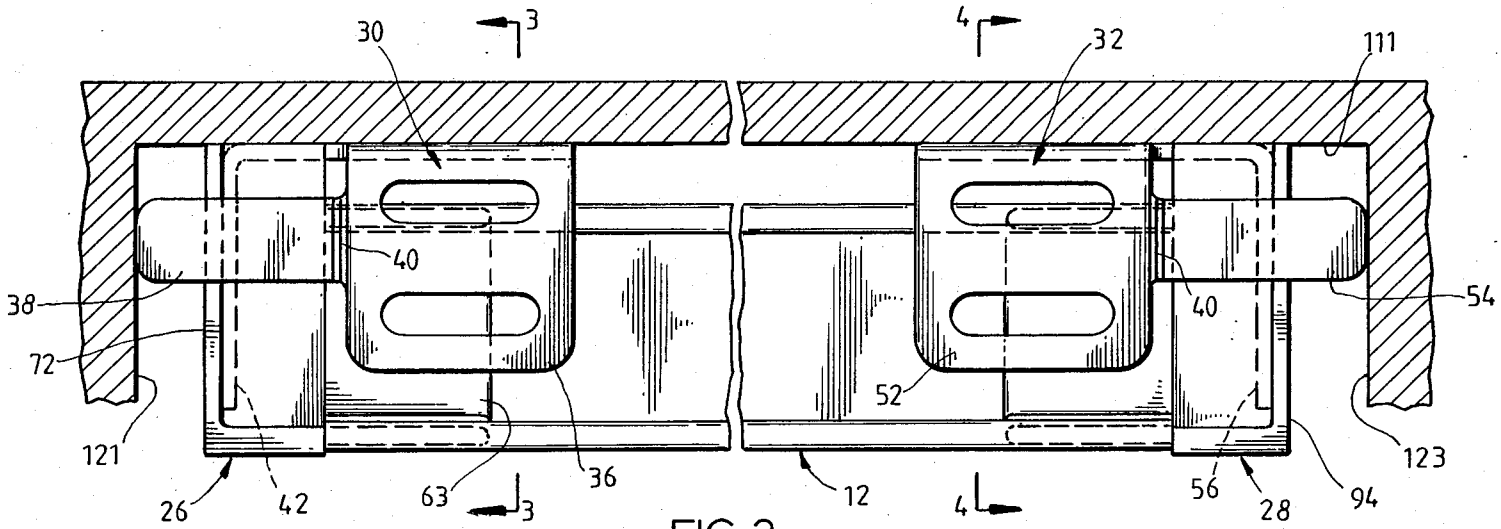
FIG. 2 is a plan view of the headrail and support bracket assembly secured to a vertical wall surface.
Figure 4:
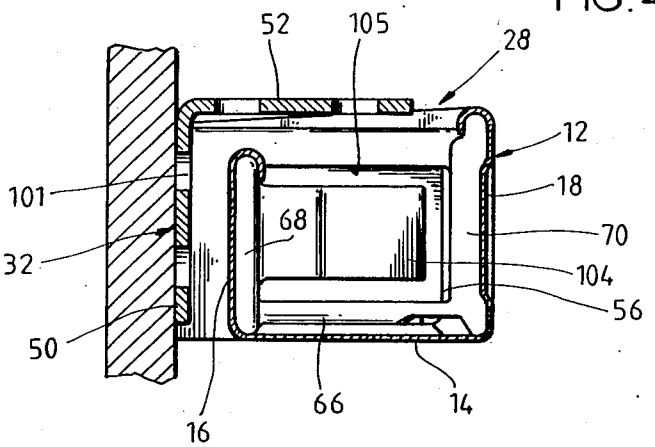
FIG. 4 is a section view taken along line 4—4 of FIG. 2.
Figure 3:
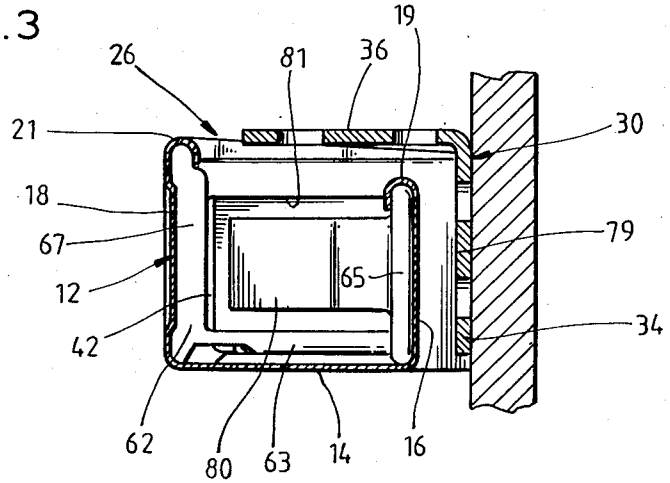
FIG. 3 is a section view taken along line 3—3 of FIG. 2.

In the description which follows like parts are marked throughout the specification and drawing with the same reference numerals, respectively. The drawing figures are not necessarily to scale and certain features of the invention may be shown exaggerated in scale in the interest of clarity. Certain parts illustrated may be mirror images of other parts and where one of the parts forming a mirror image of another part is described in detail, the other part may not be described in as great as detail since those skilled in the art will readily recognize the counterpart component portions of the mirror image part.

Referring now to FIG. 1, there is illustrated a support bracket and headrail assembly particularly adapted for use with window coverings such as venetian blinds and the like. Only those portions of the structure which are necessary for an understanding of the present invention are illustrated in the drawing figures and the venetian blind assembly itself together with actuating mechanism has been deleted in the interest of clarity and conciseness. The support assembly of the present invention is generally designated by the numeral 10 and includes an elongated headrail member 12 formed as an extruded metal or plastic generally channel shaped member having a connecting web 14 and opposed upturned flanges 16 and 18. The respective flanges 16 and 18 may be folded over at their distal ends to form retaining edges 19 and 21. The headrail member 12 may be provided with a suitable relieved surface 20 along the flange 18 for aesthetic reasons and to give additional rigidity to the headrail member. The headrail member 12 is preferably extruded or folded out of relatively thin walled metal plate and is normally adapted to support venetian blind actuating mechanism, not shown.

The headrail member 12 is also adapted to be supported across a window opening or the like by opposed support bracket assemblies including headrail support bracket members 26 and 28 and respective wall bracket members 30 and 32 which are associated with the headrail support bracket members 26 and 28, respectively. As illustrated in FIG. 1, the headrail support bracket members 26 and 28 are of so called left hand and right hand configuration and thereby also comprise mirror images of each other. In like manner, the wall bracket members 30 and 32 are also configured as left hand and right hand members although certain advantages of the present invention may be enjoyed without constructing these members as separate left and right hand parts.

By way of example, the wall bracket member 30 is preferably formed of folded metal plate and includes a vertical wall support portion 34, a horizontal wall support portion 36 which is integrally joined to the vertical wall support portion 34 and a sidewall standoff or locating tab 38. The tab 38 is formed integral with the horizontal wall or ceiling portion 36 and a score line 40 is preferably provided to facilitate removal of the tab 38 by repeated cyclic bending of the tab with respect to the bracket portion 36. The wall bracket 30 further includes a horizontally projecting planar support plate portion 42 having a notch or recess 44 formed along the bottom side 46 thereof. The wall bracket support portions 34 and 36 are provided with suitable elongated slots 47 for mounting the wall bracket using conventional fasteners, not shown.

The opposite wall bracket 32 is of mirror image configuration with respect to the wall bracket 30 and includes a vertical wall support portion 50, a horizontal wall or ceiling support portion 52 and a stand off or locating tab 54 projecting therefrom. A horizontally projecting support plate portion 56 is integral with the vertical wall support portion 50 and includes a horizontally projecting bottom edge 58 having a notch or recess 60 formed therein and corresponding to the notch 44. Fastener receiving slots 59 are formed in the vertical and horizontal wall support portions 50 and 52, respectively.

As illustrated in FIGS. 1, 3, 4, 5 and 6, the headrail support brackets 26 and 28 each have a body including headrail engaging tongue portions 62 and 64, respectively. The tongue portion 62 has a somewhat channel shaped configuration having a bottom wall or web 63 and opposed sidewalls 65 and 67. In like manner, the tongue portion 64 includes a bottom web 66 and opposed sidewalls 68 and 70. The configurations of the tongue portions 62 and 64 are such that they are snugly but freely slidable inside the channel formed by the headrail web 14 and the opposed flanges 16 and 18.

Figure 5:
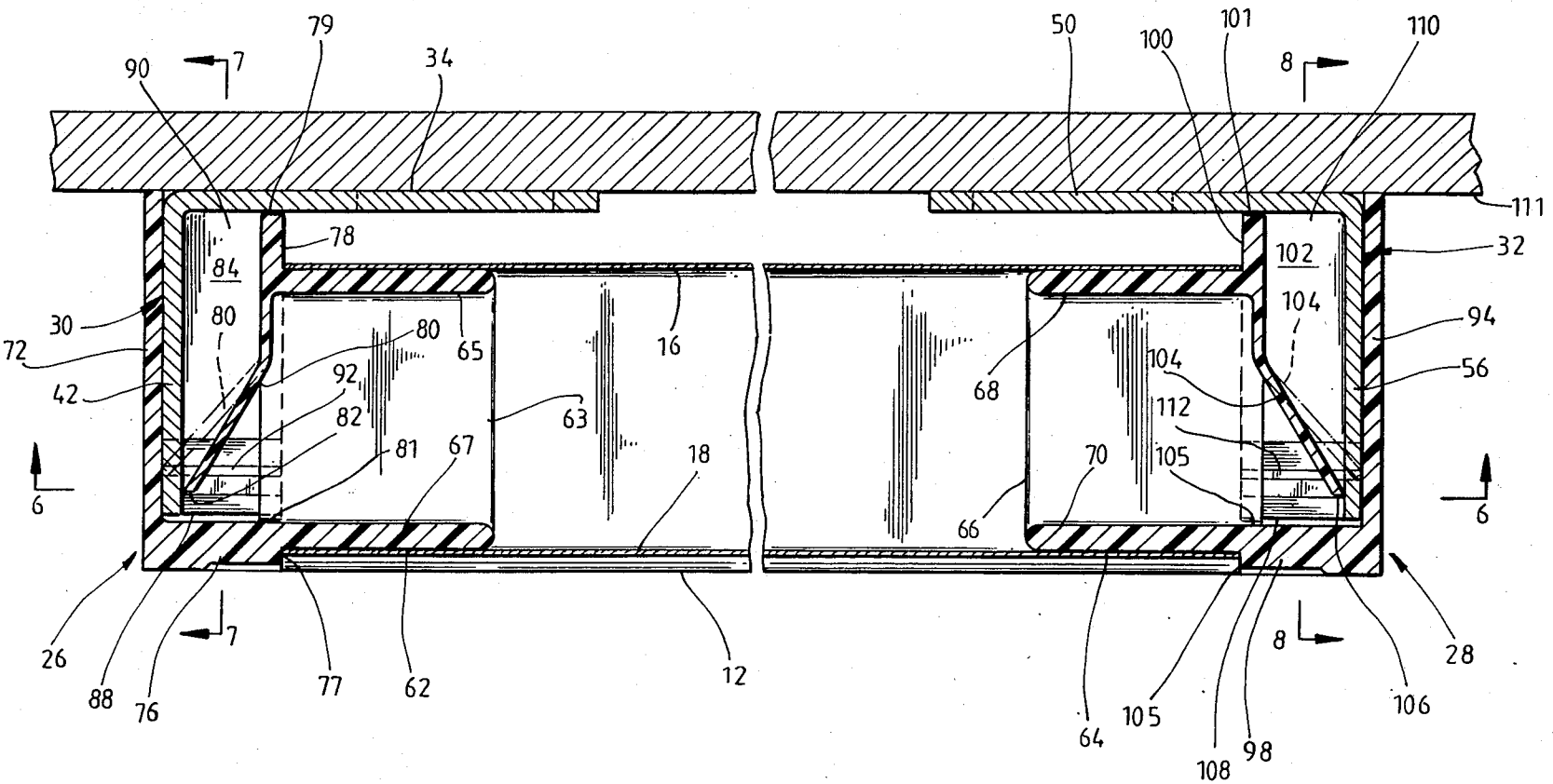
FIG. 5 is a plan view, in section taken generally along the line 5—5 of FIG. 6.
Figure 6:
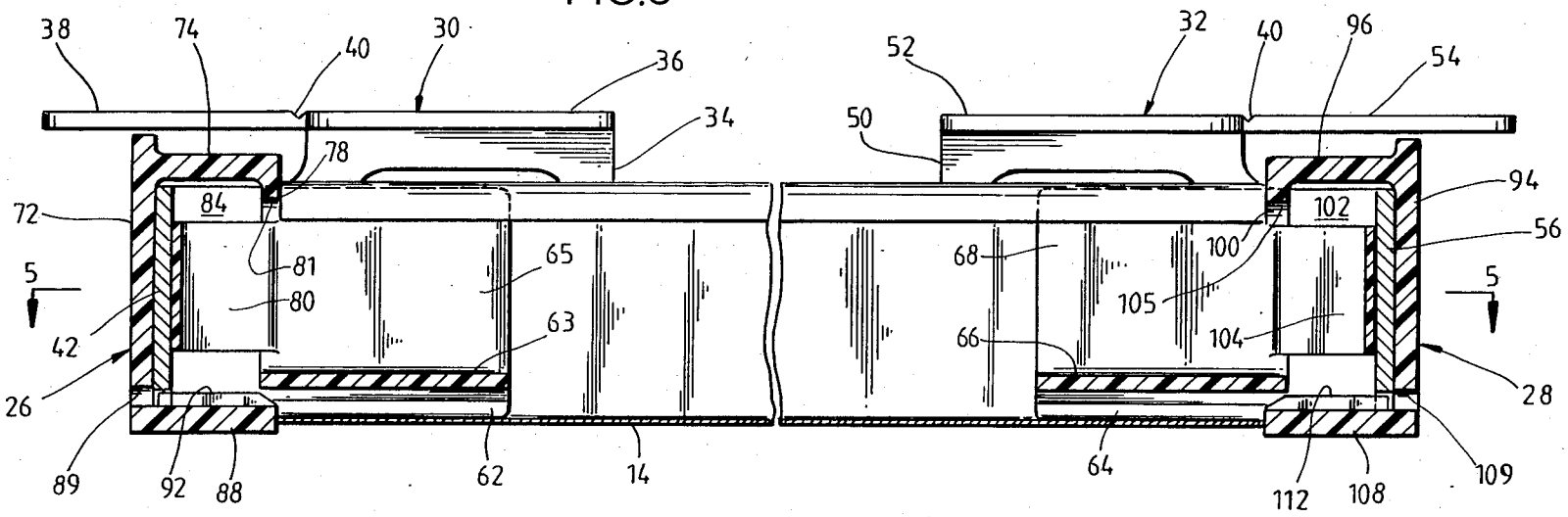
FIG. 6 is a section view taken generally along the line 6—6 of FIG. 5.

Referring further to FIGS. 5 and 6, in particular, the headrail support bracket 26 includes a transverse end wall 72 opposite the tongue portion 62, a top wall 74, FIG. 6, and a front wall 76, FIG. 5. An intermediate wall portion 78 extends parallel to and is spaced from the end wall 72 and is integral with the tongue sidewall 65. A shoulder 77 is formed by a side surface of the wall 78 and a coplanar side surface of the front wall 76 for engagement with one end of the headrail 12. An elastically deflectable bladelike arm 80 projects from and is integral with the portion of the headrail bracket member 26 defined by the juncture of the wall portions 65 and 78. The arm 80 is disposed generally in an opening 81 formed between the top wall 74 and the web 63 and has a distal end 82 extending toward the end wall 72. The spacing of the walls 72 and 78 defines an opening 84 for receiving the horizontally projecting support plate portion 42 of the wall bracket 30 and which is engageable by the arm 80 to urge the end wall 72 toward the support plate portion 42, as illustrated in FIGS. 5 and 6.

Figure 7:
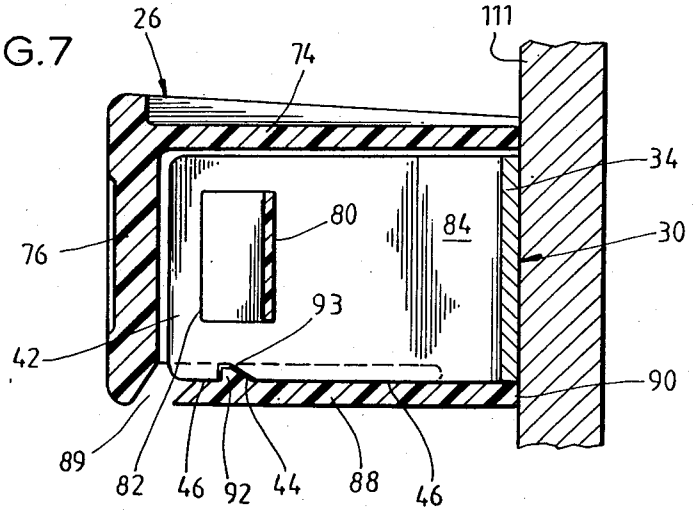
FIG. 7 is a detailed section view taken along the line 7—7 of FIG. 5.

Referring to FIGS. 6 and 7, the headrail bracket 26 includes means for retaining the bracket in assembly with the wall bracket 30 comprising a resiliently deflectable finger 88 which extends from an integral bottom wall portion 90 extending between and integral with the sidewalls 72 and 78. The finger 88 includes an upstanding projection 92 which is operable to be in registration with the notch or recess 44 in the wall bracket support portion 46 for retaining the headrail bracket 26 in assembly with the wall bracket 30. As illustrated in FIG. 7, the finger 88 terminates short of the front wall 76 to provide a gap 89 for access to engage the distal end of the finger 88 to deflect the finger downward to release forcible engagement between the projection 92 and the wall bracket 30.

Figure 8:
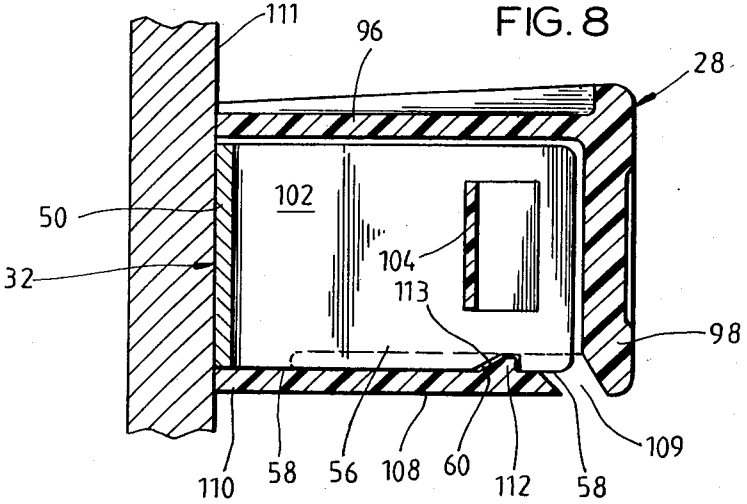
FIG. 8 is a section view taken along the line 8—8 of FIG. 5.

Referring now to FIGS. 5, 6 and 8, the headrail bracket 28 also includes a transverse end wall 94 integral with a top wall portion 96 and a front wall 98. An intermediate transverse wall portion 100 extends parallel to the end wall 94 and is spaced therefrom to define an opening 102 for receiving the horizontally projecting plate portion 56 of the wall bracket 32. The headrail bracket 28 also includes an elastically deflectable arm 104 which projects generally horizontally from the juncture of the integral wall portion 100 and the sidewall 68 toward the transverse end wall 94 as illustrated in FIG. 5. The arm 104 also extends generally in an opening 105 formed between the top wall 96 and the web 66. The arm 104 has a distal end 106 operable to urge the end wall 94 toward engagement with the support plate portion 56, as illustrated. A shoulder 105 is also formed by a side surface of the wall 101 and a coplanar side surface of front wall 98 for engagement with the opposite end of headrail 12. The headrail support bracket 28 also includes a resiliently deflectable finger 108 which extends from an integral bottom wall portion 110 extending between the end wall 94 and the intermediate wall 100. The finger 108 includes an upstanding projection 112 which is operable to be interfitted in the recess 60 and the support plate portion 56 of the wall bracket 32. The finger 108 terminates short of the front wall 98 to define a gap 109, FIG. 8, whereby the distal end of the finger may be deflected downwardly to release its engagement with the projection 112. The projections 92 and 112 include inclined ramp portions 93 and 113, FIGS. 7 and 8, respectively, to provide for forcible deflection of the fingers as they engage the plate bottom edges 46 and 58, respectively.

As illustrated in FIGS. 6 through 8, the wall bracket plate portions 42 and 56 are of an overall height slightly less than the height of the openings 84 and 102 as determined by the respective opposed wall portions 74 and 90 and the wall portions 96 and 110. Accordingly, the assembly of the headrail 12 together with the headrail brackets 26 and 28 may be supported by the wall brackets 30 and 32 by inserting the support plate portions 42 and 56 into the openings 84 and 102 until the projections 92 and 112 engage the respective notches 44 and 60 to lock the headrail brackets in assembly with the wall brackets. By merely deflecting the fingers 88 and 108 generally downwardly, viewing FIGS. 6 through 8, the projections 92 and 112 are moved out of the respective notches 44 and 60 and the headrail brackets may be removed from the wall brackets 30 and 32. When the headrail brackets 26 and 28 are in assembly with respective wall brackets 30 and 32 the arms 80 and 104 are operable to bias the headrail brackets toward each other and in engagement with the headrail 12. Moreover, the width of the opening 84 delimited by the walls 72 and 78 and the width of the opening 102 as delimited by the walls 94 and 100 are sufficient such that moderate errors in spacing of the wall brackets 30 and 32 can be accommodated and the elastically deflectable arms 80 and 104 provide snug engagement between the respective wall brackets and the headrail brackets 26 and 28.

Those skilled in the art will appreciate from the foregoing description that a mechanically uncomplicated yet unique support structure for a venetian blind headrail or the like is provided by the headrail brackets and wall brackets of the present invention. The headrail brackets 26 and 28 are preferably formed of injection molded plastic and the wall brackets 30 and 32 may also be molded plastic or formed of stamped and folded metal plate.

The walls 78 and 100 are preferably formed with recesses 79 and 101, respectively, FIG. 5, for receiving the vertical wall support portions 34 and 50 of the respective wall brackets 30 and 32, so that the headrail brackets 26 and 28 may be mounted substantially flush against a vertical wall 111 as illustrated in FIGS. 2 through 5, 7 and 8. The wall brackets 30 and 32 may be installed in a conventional manner using predetermined measurements for the spacing of the brackets or the brackets may be preassembled with the headrail support brackets 26 and 28 and the headrail and placed in a position on a wall surface for marking of the location of the wall brackets. The wall brackets 30 and 32 may then be removed from the respective headrail brackets and mounted in the marked location. The assembly of the headrail brackets 26 and 28 and the headrail 12 may then be installed on the mounted wall brackets by merely pushing the headrail brackets onto the respective horizontally projecting plate portions 42 and 56. When it is desired to remove the headrail support brackets 26 and 28, the respective fingers 88 and 108 are manually depressed downwardly to release engagement of the projections 92 and 112 with the respective plate portions 42 and 56 whereby the brackets may be removed in assembly with the headrail 12. Thanks to the provision of the projecting tabs 38 and 54, the wall brackets 30 and 32 are automatically prevented from being mounted in such a way that the support plate portions 42 and 56 are located too close to adjacent wall surfaces such as the surfaces 121 and 123 illustrated in FIG. 2. The tabs 38 and 54 may be removed after they have performed their locating function.

Although a preferred embodiment of the invention has been described in detail herein those skilled in the art will recognize that various substitutions and modifications may be made to the invention without departing from the scope and spirit of the appended claims.

What I claim is:

1. A support bracket assembly for a venetian blind headrail or the like, said headrail comprising an elongated member having means forming an opening at opposite ends thereof, said support bracket assembly comprising:

a pair of opposed headrail bracket members, each of said bracket members including a projecting tongue portion for insertion into said means forming openings in said headrail for supportive engagement of said headrail;

a pair of opposed wall bracket members, each being adapted for mounting on a wall surface and having a generally horizontal projecting portion; and said headrail bracket members each including means for receiving said generally horizontally projecting support portion of said wall bracket member, respectively, said headrail bracket members each also including a finger member including projection means thereon, said projection means engageable with cooperating notch means formed along a bottom side of said generally horizontally projecting support portion of said wall brackets, respectively, said finger means being resiliently deflectable to selectively provide locking engagement of said headrail bracket members to said wall brackets or move said projection out of engagement with said generally horizontally projecting support portion to permit removal of said headrail bracket member from said wall bracket.

2. The support bracket assembly set forth in claim 1 wherein:

each of said headrail bracket members include elastically deflectable means engageable with said support portions of said wall brackets for urging said headrail bracket members toward supportive engagement of said headrail.

3. The support bracket assembly set forth in claim 2 wherein:

said elastically deflectable means comprises an arm having a distal end extending toward a transverse end wall of said headrail bracket for urging said end wall toward said support portion when said headrail bracket is mounted on said wall bracket.

4. The support bracket assembly set forth in claim 1 wherein:

said wall bracket includes a wall surface support portion joined with said first mentioned support portion, and projecting tab means extending generally normal to said wall surface support portion to predetermine the minimum spacing between said first mentioned support portion and a surface adjacent said wall bracket to provide clearance for said headrail bracket.

5. The support bracket assembly set forth in claim 1 wherein:

said headrail bracket has an end wall, a front wall, a top wall, and a bottom wall portion defining an interior space for receiving said support portion of said wall bracket, said walls being shaped to conform generally to the cross-sectional shape of said headrail.

6. A support bracket for supporting a headrail member of a venetian blind or similar window covering wherein said headrail comprises a generally hollow or open sided member, said support bracket comprising:

a body including a tongue portion having a cross-sectional shape to provide for snug but slidable engagement with said headrail, a transverse end wall of said body delimiting at least partially an opening for receiving a projecting portion of a wall bracket for support of said support bracket on said wall bracket, a finger including projection means thereon engageable with cooperating notch means formed along a bottom side of said support portion of said wall brackets, respectively, for retaining said support bracket secured to said wall bracket and for releasing said support bracket from engagement with said wall bracket upon movement of said resiliently deflectable means at will, and elastically deflectable means projecting into said opening for engagement with said support portion of said wall bracket for urging said support bracket into engagement with said headrail.

7. The support bracket set forth in claim 6 wherein:

said elastically deflectable means comprises an arm having a distal end extending toward a transverse end wall of said support bracket for urging said end wall toward said support portion when said support bracket is mounted on said wall bracket.

8. A support bracket assembly for a headrail of a venetian blind or similar window closure means, said headrail comprising an elongated member having means forming an opening at opposite ends thereof, said support bracket assembly comprising:

a pair of opposed headrail support members, each of said support members including a projecting tongue portion for insertion into said means forming said openings in said headrail for supportive engagement of said headrail;

a pair of opposed wall brackets, each of said wall brackets being adapted for mounting spaced apart from each other on a wall surface and having a generally horizontally projecting plate portion;

said support members each including means for receiving said plate portion of wall bracket, respectively, said support members easch also including a resiliently deflectable finger engageable with said plate portion to provide locking engagement of said support member on said wall bracket, each of said resiliently deflectable fingers including projection means thereon engageable with cooperating notch means formed along the bottom side of said plate portion of said wall brackets, respectively, said fingers being resiliently deflectable to move said projections out of engagement with said plate portions to permit removal of said support members and said headrail in assembly from said wall brackets; and elastically deflectable means on said support members, respectively, engageable with said wall brackets for urging said support members to substantially center said headrail between said wall brackets.

* * * * *